US010519989B2

(12) United States Patent
Handle et al.

(10) Patent No.: US 10,519,989 B2
(45) Date of Patent: Dec. 31, 2019

(54) SAFE-TO-OPERATE HYDRAULIC DRIVE

(71) Applicant: MOOG GmbH, Boeblingen (DE)

(72) Inventors: Werner Handle, Marbach (DE); Reiner Kohlhaas, Osburg (DE); Tim Reidl, St. Gallen (CH)

(73) Assignee: MOOG GmbH, Boeblingen (DE)

( * ) Notice: Subject to any disclaimer, the term of this patent is extended or adjusted under 35 U.S.C. 154(b) by 93 days.

(21) Appl. No.: 15/739,655

(22) PCT Filed: Apr. 27, 2016

(86) PCT No.: PCT/IB2016/052392
§ 371 (c)(1),
(2) Date: Dec. 22, 2017

(87) PCT Pub. No.: WO2016/207741
PCT Pub. Date: Dec. 29, 2016

(65) Prior Publication Data

US 2018/0180072 A1 Jun. 28, 2018

(30) Foreign Application Priority Data

Jun. 25, 2015 (EP) ..... 15173939

(51) Int. Cl.
*F15B 20/00* (2006.01)
*F15B 11/04* (2006.01)

(52) U.S. Cl.
CPC ..... *F15B 20/007* (2013.01); *F15B 11/0413* (2013.01); *F15B 2211/20515* (2013.01);
(Continued)

(58) Field of Classification Search
CPC ..... F15B 2211/4159; F15B 20/007; F15B 2211/40592; F15B 11/0413; F15B 2211/7053
See application file for complete search history.

(56) References Cited

U.S. PATENT DOCUMENTS 2,999,482 A * 9/1961 Bower ..... F15B 11/0426 137/599.04
3,877,347 A * 4/1975 Sheesley ..... F15B 7/006 188/312

(Continued)

FOREIGN PATENT DOCUMENTS

DE 102009043034 A1 3/2011
DE 102011116964 A1 5/2012

(Continued)

OTHER PUBLICATIONS

PCT/IB2016/052392 ISR and Written Opinion dated Aug. 8, 2016 Handle-Moog GmbH.

(Continued)

*Primary Examiner* — Thomas E Lazo
(74) *Attorney, Agent, or Firm* — Douglas Denninger

(57) ABSTRACT

A safe hydraulic drive system and process, comprising at least one first cylinder chamber and a second, separate cylinder chamber which are connected to one another via a connecting line to form a fluid-filled hydraulic circuit, and a hydraulic drive for conveying the fluid from one cylinder chamber, via the connecting line, into the other cylinder chamber in which the connecting line is arranged. The connecting line has at least one parallel system, between the hydraulic drive and one of the two cylinder chambers, including at least one first sub-connection with at least one first stop valve and a second sub-connection with a baffle arranged therein. The connecting line, excluding the second sub-connection, has a first flow resistance and the second sub-connection has a second flow resistance due to the baffle arranged therein, which is greater than the first flow resistance for the fluid, wherein the drive system is provided with at least one open first stop valve in normal mode and with a closed first stop valve in safe mode for conveying the fluid, and a suitably high second flow resistance has been selected (Continued)

so that a maximum permissible speed for a piston rod is not exceeded in safe mode, even when an external force acts on the drive system in the direction of movement of the piston rod.

13 Claims, 3 Drawing Sheets

(52) U.S. Cl.
CPC . *F15B 2211/20561* (2013.01); *F15B 2211/27* (2013.01); *F15B 2211/30515* (2013.01); *F15B 2211/40507* (2013.01); *F15B 2211/41572* (2013.01); *F15B 2211/47* (2013.01); *F15B 2211/6326* (2013.01); *F15B 2211/7054* (2013.01); *F15B 2211/75* (2013.01); *F15B 2211/8752* (2013.01)

(56) References Cited

U.S. PATENT DOCUMENTS 4,715,264 A * 12/1987 Stoll ..... B23Q 5/268 251/129.02
RE32,588 E 2/1988 Bowen
5,142,963 A * 9/1992 Piekutowski ..... F15B 13/0417 91/31
6,543,223 B2 * 4/2003 Muschong ..... B25B 5/061 60/476
7,788,918 B2 * 9/2010 Huber ..... F15B 11/08 60/475
2010/0154399 A1 6/2010 Bergstroem
2012/0272708 A1 11/2012 Scheidl
2014/0033698 A1 * 2/2014 Opdenbosch ..... F15B 7/006 60/422
2014/0245734 A1 * 9/2014 Kim ..... F15B 7/006 60/469
2017/0108014 A1 * 4/2017 Handle ..... B30B 15/161

FOREIGN PATENT DOCUMENTS

GB 1048285 11/1966
JP 2007-146867 A 6/2007
WO WO-02086327 A1 * 10/2002 ..... F15B 11/0426
WO WO-2012/062416 A1 5/2012
WO WO-2015059546 A1 * 4/2015 ..... F15B 11/048

OTHER PUBLICATIONS

PCT/IB2016/052392 International Prelim Report on Patentability dated May 23, 2017 Handle-Moog GmbH.

* cited by examiner

SAFE-TO-OPERATE HYDRAULIC DRIVE

CROSS-REFERENCE TO RELATED APPLICATIONS

This application is a national phase filing under 35 USC § 371 of international application No. PCT/IB2016/052392 filed 27 Apr. 2016, which claims priority to EP Application No. 15173939.8 filed 25 Jun. 2015. The entire contents of each of the above-mentioned applications are incorporated herein by reference.

FIELD OF THE INVENTION

The invention relates to a safe hydraulic drive system and a method for operating such a drive system.

BACKGROUND OF THE INVENTION

Systems with hydraulic drives are used for various purposes. For machines with moving axes, the functional safety of these machines is determined by the machine design and machine control. For example, whereas with horizontal moving axes of the machines, it can be assumed that in the deenergized state there is no hazard to persons due to the external force acting on the axes, for example the force of gravity, the vertical axes are subjected to the force of gravity, which could cause an excessively fast or even undesirable lowering of a load along the vertical axis. This type of undesirable or excessively fast lowering of an axis or the load attached thereto represents a significant accident potential during operation, which must be prevented or at least avoided through suitable measures during the machine design. Electromechanical drives have a rigid coupling between the motor shaft and the actuator. Thus, a rotary encoder on the motor gives a representative value of the actuator speed. A rotational speed (rpm) monitoring unit monitors this value and initiates stopping the axis if this value is exceeded. Under normal conditions, the vertical axes can be stopped by a holding brake installed in the drive motor, so that the load does not fall unintentionally. For example, a maximum speed of the actuator can be monitored by evaluating the rotational speed of the motor when there is a rigid, secure coupling between the motor shaft and the actuator. With hydrostatic drives however, slippage can occur between the motor shaft and the actuator, whereby a lowering movement can exceed a permissible maximum speed, even if the rotational speed of the motor is not exceeded. If a force in the direction of movement acts upon a suspended load, for example, the actuator at the end of the drive train will exceed the speed allocated by the motor shaft, which means that an accurate evaluation of the motor speed alone is insufficient for the reliable detection of the speed. For this purpose, additional baffles can be arranged in the discharge and/or feed lines of the hydraulic cylinders. The baffle diameter, designed based on the maximum load ratios and supply pressure, limits the volumetric flow in the hydraulic lines, which limits the speed, for example, of a piston, to a maximum value determined by the baffle diameter. These baffles, however, represent resistance to the piston movement since the baffles are designed for the maximum supply pressure and the unfavorable load situation. This results in a loss of power at the baffles, which, when the hydrostatic gear units are closed, leads to a significant rise in temperature and limits the period of use in this operating state. In the state of the art GB 1 048 285 A is known, showing a hydraulic drive system for moving a piston rod of at least one cylinder. Furthermore, JP 2007 146867 A discloses a pneumatic circuit of an actuator capable of reducing a quantity of the air consumption of a compressor. US Re. 32,583 discloses a pneumatic-hydraulic proportional valve actuator system with adjustable means of achieving two stroking speeds by the hydraulic actuator.

SUMMARY OF THE INVENTION

The object of the present invention is to provide a safe, easy-to-operate, and economical drive system for moving objects with a low loss balance at a safely reduced speed as required.

This object is achieved with a hydraulic drive system for moving a piston rod of at least one cylinder, comprising at least one first cylinder chamber and a second, separate cylinder chamber, which are connected to one another via a connecting line, to form a fluid-filled hydraulic circuit and a hydraulic drive for conveying the fluid from one cylinder chamber into the other cylinder chamber via the connecting line, in which the connecting line is arranged, wherein the connecting line has at least one parallel system, between the hydraulic drive and one of the two cylinder chambers, of at least one first sub-connection with at least one first stop valve and a second sub-connection with a baffle arranged therein, wherein the connecting line, excluding the second sub-connection, has a first flow resistance and the second sub-connection has a second flow resistance due to the baffle arranged therein, which is greater than the first flow resistance for the fluid, wherein the drive system is provided with at least one open first stop valve for conveying the fluid in normal mode and with a closed first stop valve in safe mode, and the second flow resistance has been selected so as to be suitably high, so that the piston rod does not exceed a maximum permissible speed in the safe mode, even when there is an external force acting upon the drive system in the direction of movement of the piston rod.

The first flow resistance of the connecting line, including the first sub-connection, is determined, for example, by the smallest first cross-sectional area in this connection, through which the fluid can flow. The second flow resistance is determined by the baffle in the second sub-connection, wherein the baffle, for example, has a cross-sectional area, through which the fluid is able to flow, suitably reduced in comparison with the first cross-sectional area in order to provide the second flow resistance.

Hydraulic drive systems such as the drive system according to the invention are characterized by their robustness and their straightforward controllability compared to other drive systems. The drive system according to the invention also enables a normal mode in which the power loss is determined by the first flow resistance or the first cross-sectional area. This first flow resistance can be selected within the scope of the present invention so that the power loss is low due to a low first flow resistance, even at a maximum force provided by the hydraulic drive. The higher second flow resistance, on the other hand, effects a higher power loss only in safe mode since the fluid being conveyed flows exclusively through the second sub-connection only in this operating mode. In safe mode, the fluid can continue to be actively conveyed by the hydraulic drive or flow solely through the second sub-connection due to the external force. In the drive system according to the invention, the increased loss of power caused by safety baffles in the typical safely designed hydraulic drives, which are designed for a maximum supply pressure and maximum pulling load, is limited exclusively to the maximum pulling load by the baffle, designed as a safety baffle, and thus only to the safe mode, implemented as needed in exceptional cases and for very briefly limited time periods. Thus, the average loss of power of the drive system according to the invention is significantly less than with the typical safely designed hydraulic drive systems. By operating the drive system in safe mode and the associated switchover to the second sub-connection with the baffle designed for the pulling force, the volumetric flow is sufficiently limited by the second sub-connection in order also to ensure a limitation of the rotational speed of the hydraulic motor according to the volumetric flow. In addition, this drive system is economical since complex precision components (for example a reliable detection of the actuator speed) are not required for the hydraulic drive due to the hydraulic limiting of the maximum potential speed of the piston rod in safe mode by the baffle.

Thus, the drive system according to the invention represents a safe, easy-to-operate, and economical drive system for moving objects with a low loss balance at a safely reduced speed as required.

Here, the term "cylinder" denotes all types of cylinders that are suitable for implementing a movement sequence, i.e. a movement of the piston rod with the desired force at the desired speed. Such cylinders can be differential cylinders, synchronized cylinders, or tandem cylinders. The direction of movement of the piston rod is specified by the alignment of the cylinder and can be parallel to the external force (e.g. force due to gravity) or at an angle to the external force. Accordingly, the force due to gravity acts completely or only partially on the object (weight) attached at the piston rod. Depending on the type of use and the alignment of the cylinder, the second cross-sectional area and thus the second flow resistance can be designed with different sizes. If the maximum permissible speed of the piston rod is higher in safe mode, then the second cross-sectional area can be greater and thus a lower second flow resistance can be selected. The second flow resistance is always higher than the first flow resistance, and thus, for example, the second cross-sectional area is always smaller than the first cross-sectional area. The first cross-sectional area here denotes the smallest cross-sectional area in the connecting line outside of the second sub-connection, which thus determines the first flow resistance. The cross-sectional areas in the remaining parts of the connecting line through which fluid passes can be designed differently, wherein they can be greater than or the same size as the first cross-sectional area but are at least significantly greater than the second cross-sectional area. Here, the first cross-sectional area indicates the smallest cross-sectional area in the entire connecting line through which fluid passes, with the exception of the second sub-connection, in which the second cross-sectional area is arranged in the form of a baffle, which is smaller than the first cross-sectional area.

According to the invention, the baffle is designed based on the maximum external force, for example the gravitational force. The substantial loss of power at the baffle occurs only in safe mode according to the invention, whereby the entire power loss balance of the drive system is thus significantly better and the operating state can be better operated at a safely reduced speed. As well, the baffle can have various shapes. For example, the baffle can only have the second cross-sectional area in one location, while the baffle has a larger cross-sectional area through which fluid can pass before and/or after it. Here, the second cross-sectional area can have any shape suitable for the application, for example circular, elliptical, rectangular or another shape. In another embodiment, the baffle can have the second cross-sectional area over a longer section. The cross-sectional area here can vary in shape while having the same surface area. In another embodiment, the baffle extends along the entire second sub-connection. In another embodiment, the baffle is a baffle with an adjustable second cross-sectional area for adapting the maximum potential speed to various applications in safe mode, for example for installation in various machines for various tasks with different safety requirements.

The term "fluid" here denotes any fluid that is suitable for transferring mechanical energy in hydraulic systems. Suitable hydraulic fluids have good lubrication properties, long aging resistance, and high wetting and adhesive properties. In addition, they should be compatible with seals and should be free of resins and acids and exhibit a low temperature influence on the dynamic and kinematic viscosity, low compressibility, and low foam formation. Suitable hydraulic fluids are, for example, mineral oils, also called hydraulic oils, or flame-resistant fluids such as HFA, HFB, HFC, or HFD. Here, conveying the fluid denotes displacing (advancing) hydraulic fluid through the connecting line of the hydraulic circuit from one cylinder chamber into another cylinder chamber and back, depending on the desired direction of movement and movement pattern of the piston rod.

The hydraulic fluid in this case is conveyed in the connecting line as a closed pressure circuit. The term "closed" denotes the lack of oil tanks open to the ambient air, to equalize the oil in the hydraulic drive. The closed pressure circuit is a system consisting of the connecting line and the cylinder, from which hydraulic fluid cannot exit during operation, except where there are leaks. Here, the pressure circuit or the connecting line can have other branching points at which multiple lines branch out or come together. The hydraulic drive system according to the invention can be preloaded, i.e. can be under a permanent increased pressure. Preloading the hydraulic fluid increases the compressive modulus of the fluid. This increases the natural frequency of the system, which leads to an improvement in the dynamic properties. Furthermore, the pretensioning prevents the pump from becoming damaged due to the effects of cavitation. The pretensioning pressure in this case can be more than 5 bar, for example. The term "closed pressure circuit" also means that the pretension pressure can be kept constant, for example, via a pressure source, which is connected to the otherwise closed pressure circuit via a check valve. The check valve only enables the equalization of leaks at the pressure source.

The hydraulic drive can be any hydraulic machine suitable for supplying the force for moving a piston rod, for example a hydraulic machine with a modifiable rotational speed. Here, the movement of the piston rod by means of the hydraulic drive system denotes the entire movement cycle of the components, which are moved by the hydraulic system. A movement cycle of the piston rod has been completed, for example, when the same position of the cylinders and the piston rod has been reached after passing through a first and a second dead center. The dead center is the point at which the piston rod comes to rest and then reverses its direction of movement. The operating cycle can be completed in normal mode and in safe mode. The "stop" operating phase is reached when the piston rod comes to rest.

At the same time, the hydraulic drive system according to the invention manages with a minimum number of components, keeps installation expenses low, improves energy efficiency, can be installed compactly, and can be operated with sufficient variability. In particular, the hydraulic drive system only requires a single actuator (the hydraulic drive) in order to supply the cylinder with fluid and to move the piston rod.

In one embodiment, the first stop valve can be controlled electronically and the drive system incorporates a drive control to actuate the hydraulic drive for moving the piston rod and for electronically switching the stop valves for at least normal mode and safe mode. Thus, the complete drive system can be very easily controlled and operated in the desired manner. To this end, the drive control can comprise one or multiple processors and/or storage media for storing and executing sequence plans in the various operating modes.

In one embodiment, the hydraulic drive incorporates a tachometer for monitoring the rotational speed of the hydraulic motor, wherein the tachometer is connected to the drive control for at least safe limiting of the rotational speed by the drive control. Here, in addition to the pump for conveying the hydraulic fluid in the connecting line, the hydraulic drive denotes all additional components required for operating the pump. The expert is able to select suitable hydraulic drives within the scope of the present invention. Here, the tachometer according to the invention can be arranged on the pump or on another component, for example, and the rotational speed of the pump for adjusting the volumetric flow conveyed can be determined by means of its rotational speed measurement. By limiting the rotational speed, the hydraulic drive can be operated in safe mode with a volumetric flow through the second sub-connection adjusted via the rotational speed, wherein the baffle limits only the maximum volumetric flow by means of the second flow resistance. Thus, with a gear unit subject to slippage on the hydraulic drive and simultaneous monitoring of the rotational speed for safe speed limitation of the piston rod in safe mode, only the volume slippage due to the gear unit subject to slippage on the hydraulic drive needs to be compensated by means of the second flow resistance provided by the baffle, so that the external force cannot generate a piston rod speed in excess of the adjusted rotational speed of the hydraulic drive. This means that baffles having a lower second flow resistance than in drive systems according to the invention can be used for safe mode with hydraulic drives, whose rotational speed is monitored and can thus be limited, without such rotational speed monitoring and rotational speed control of the hydraulic drive. Thus, the loss of power in safe mode can be reduced in drive systems according to the invention with hydraulic drives, whose rotational speed is monitored, and thus the power loss can be further improved as a whole. Limiting the rotational speed of the hydraulic drive, together with the volumetric flow limitation achieved by the baffle, produces the feature of a safely limited piston rod speed. By safely limiting the speed of the piston rod, even under the effects of an external force, such as the force of gravity, by means of the baffle and the rotational speed limiting achieved thereby, any disadvantages of the hydraulic drive, such as slippage of fluid through the pump, are compensated for in a safe manner, such that the combination adds the advantages of the hydraulic drive to those of a safe drive system (safe motor speed), which means that the drive system according to the invention is safe, easy to operate, and has a still lower loss balance.

In another embodiment, the hydraulic drive is an electro-hydrostatic drive with an electric motor and a hydraulic pump driven by the electric motor via a motor shaft, wherein the tachometer is provided for measuring the rotational speed of the electric motor. The motor speed can be easily measured, compared to the piston rod position and dynamics. Therefore, this control parameter is particularly well-suited for straightforward and reliable control of the drive system. Thus, the hydraulic drive only comprises a single pump and a motor mechanically coupled to the pump via the motor shaft for driving the pump, wherein the rotational speed of the motor can be variable and/or the pump can be a variable displacement pump. With only one pump, the hydraulic drive only comprises a single actuator (the pump) and thereby avoids an unnecessarily greater number of components. Preferably, the motor is an electric motor. It is especially preferable if the motor is an electric motor with a variable rotational speed and the pump is a fixed displacement pump. The energy efficiency of the hydraulic drive system can be greatly improved, in particular, by the pump drive with a variable rotational speed.

In one embodiment, the drive control incorporates a safety logic circuit, which is provided so that at least the first stop valve switches from normal mode to safe mode in response to safety signals received. This type of switchover can become necessary, for example, if persons gain access to or wish to gain access to a safety-relevant area around the machine with the drive system according to the invention.

There may be many different reasons for gaining access to this area. Provided this safety-relevant area is encapsulated and access to this area is monitored, for example by means of electronic door contacts, these monitoring units can transmit safety signals to the system control and, in response to this, the safety logic circuit will switch to safe mode (safely reduced or limited speed). Safe mode can also comprise an arranged stop or the machine proceeding to a stop.

In another embodiment, the safety logic circuit is provided in order to switch from normal mode to safe mode when the hydraulic drive is overloaded and at least to throttle the hydraulic drive (for example motor and/or pump), preferably to stop the hydraulic drive. This safety function can also be executed, for example, by the safety logic circuit in the drive control. An overload can be detected, for example, when a maximum rotational speed of the motor or the pump is exceeded or a maximum temperature of a hydraulic drive or one of its components is detected. Preferably, the hydraulic drive incorporates one or more temperature sensors, which are connected to the drive control/safety logic circuit for this purpose. Preferably, the safety logic circuit is provided to stop the hydraulic drive when its maximum rotational speed is exceeded, for example by stopping the electric motor of the hydraulic drive. Where there is a hydraulic drive whose rotational speed is monitored, the switchover to safe mode is also associated with limiting the rotational speed of the hydraulic drive during the switchover in accordance with the desired speed limitation of the piston rod.

In one embodiment, a second stop valve is arranged in the connecting line outside of the first sub-connection in order to enable the drive system to be safely shut down. If the second stop valve is also arranged outside of the second sub-connection, merely closing the second stop valve is sufficient to ensure the safe shutdown of the drive system. In another embodiment, the second stop valve is arranged in the second sub-connection in series with the baffle. Here, the second stop valve in the second sub-connection can be open or closed in normal mode. Preferably, the second stop valve is closed in normal mode in order to bring the piston rod to a stop solely by closing the first stop valve (and/or the third stop valve, if present) in the event of an emergency. In both cases, the first closing of the second stop valve provides the basis for a shutdown of the drive system. In this case, the second stop valve, as well as the first switching valve, is preferably connected to the drive control in order to be actuated by the drive control and is designed to be able to be switched electronically.

The first and second stop valves denote all stop valves suitable for operating a hydraulic drive system that can be closed, in at least one switch position, that is, where fluid can no longer flow through these (blocked position), and which can be opened in at least one other switch setting in order for fluid to flow through on both sides, i.e. in both directions. In a simple embodiment, the first and second stop valves can be 2/2-way valves. In other embodiments, the stop valves can also enable more than the two open and closed switch settings. For example, the stop valves can also incorporate a return setting (switching valve). The number of stop valves in the connecting line can also be greater than indicated here within the scope of the present invention, depending on the application, which applies both to the first and second sub-connections, as well as to the remaining connecting line.

In one embodiment, the first sub-connection incorporates a third stop valve arranged in series with the first stop valve, which preferably takes on the same switch settings as the first stop valve in normal mode and in safe mode. Due to the redundancy based on two stop valves in the first sub-connection, the switchover to safe mode can take place particularly reliably since, for a successful switchover, only one of the two stop valves (first or third) must be switched to the blocking setting in order to direct the fluid being conveyed exclusively through the second sub-connection. In addition, when the first stop valve is closed, the third stop valve is not loaded, which means that the functionality of the third stop valve can be guaranteed over a longer period than with only one stop valve in the first sub-connection, which will further increase system safety. In another embodiment, at least the first and second stop valve are closed when the drive system comes to a stop. Thus, the conveyance of the fluid from one cylinder chamber to the other cylinder chamber is prevented. In a preferred embodiment, all stop valves are closed in order to close at least the first sub-connection redundantly and therefore especially safely.

In another embodiment, the second stop valve can also be switched electronically, and preferably the third stop valve (if present) can also be switched electronically. This means that the stop valves can be quickly and reliably switched over from a normal mode into the safe mode in case of an emergency. In addition, the electronic actuation enables the use of control signals, which are generated, if required, by additional components of the drive system.

The invention also relates to a method for operating the drive system according to the invention, comprising at least one cylinder with at least one cylinder chamber and a separate, second cylinder chamber, which are connected to one another via a connecting line in order to form a fluid-filled hydraulic circuit with a hydraulic drive arranged therein, and where the connecting line has at least one parallel system between the hydraulic drive and one of the two cylinder chambers, consisting of at least one first sub-connection with at least one first stop valve and a second sub-connection with a baffle arranged therein, wherein the connecting line, including the first sub connection and excluding the second sub-connection, has a first flow resistance and a second sub-connection, and a second flow resistance determined by the baffle arranged therein is greater than the first flow resistance for the fluid, comprising the following steps:

opening at least the first stop valve for a normal mode of the drive system;

conveying the fluid by means of the hydraulic drive in normal mode, from one cylinder chamber, at least via the first sub-connection, into the other cylinder chamber in order to move a piston rod of the cylinder;

closing the first stop valve for operating the drive system in a safe mode, wherein a maximum permissible piston rod speed is not exceeded in the safe mode, even where an external force acts on the drive system in the direction of movement of the piston rod, by selecting a suitably high second flow resistance.

Here, for example, the external force is the force of gravity. By opening the first stop valve, in normal mode, the fluid flows through the connecting line with a first flow resistance, which is geared toward as low a loss of power as possible. After the first stop valve has been closed, the fluid must flow through the second sub-connection with a greater second flow resistance, which, due to the design of the baffle, results in a safe speed reduction to a maximum permissible speed. While this causes a greater loss of power in safe mode, the greater loss of power, however, is solely limited to the "safe mode" operating state. Thus, the loss of power in the drive system according to the invention is significantly less than in the speed-limited drive systems with a baffle in the single connecting line for normal mode.

In one embodiment, the process includes the additional step of conveying the fluid by means of the hydraulic drive, in safe mode, from one cylinder chamber into the other cylinder chamber via the second sub-connection in order to move the piston rod of the cylinder.

In another embodiment, the process includes the additional step of actuating the hydraulic drive in order to move the piston rod and at least the first stop valve by means of a drive control of the drive system for at least normal and safe mode, for which reason, at least the first stop valve is designed to be able to be switched electronically.

In another embodiment, the process includes the following additional steps:

Receiving safety signals by means of the drive control, which also incorporates a safety logic circuit; and Switching from normal mode to safe mode based on the safety signals received from the safety logic circuit.

In another embodiment of the process, wherein the hydraulic drive incorporates a tachometer for monitoring the rotational speed of the hydraulic motor, wherein the tachometer is connected to the drive control in order at least to limit the rotational speed safely by means of the drive control, the process includes the following additional steps:

Transmitting a rotational speed of the hydraulic drive measured by the tachometer to the drive control;

Controlling the movement of the piston rod by the drive control by means of the transmitted rotational speed; and Switching from normal mode to safe mode by means of the drive control when the hydraulic drive is overloaded, in order at least to throttle the hydraulic drive; preferably, the hydraulic drive is stopped.

The drive control can perform the switchover to safe mode, for example, when a designated maximum speed, as a rotational speed of the hydraulic drive, is exceeded; preferably, the hydraulic drive is stopped and all existing switching valves (the first, the second, and any other switching valves) are closed. In another embodiment, the drive control performs the switchover from normal mode to safe mode when the hydraulic drive is overloaded, in order at least to throttle the hydraulic drive; preferably, the hydraulic drive is stopped.

In another embodiment, the process includes the additional step of closing a second stop valve, which is arranged outside of the first sub-connection, to enable the drive system to be shut down. If the second stop valve is also arranged outside of the second sub-connection, merely closing the second stop valve is sufficient to ensure the safe shutdown of the drive system. If the second stop valve is arranged in the second sub-connection, the first stop valve must also be closed in order to shut the drive system down safely. In both cases however, only closing the second stop valve enables the drive system to be shut down. Here, the second stop valve, as well as the first switching valve, is preferably connected to the drive control in order to be actuated by the same and is designed to be able to be switched electronically.

In another embodiment of the process, wherein the second stop valve is arranged in the second sub-connection in series with the baffle, the process includes the following additional steps:

closing the second stop valve in normal mode and opening the second stop valve to operate the drive system in safe mode.

By closing the second stop valve in normal mode, only the first stop valve still has to be closed in order to shut down the drive system. Thus, the shutdown can be engaged by only a single switching process.

BRIEF DESCRIPTION OF THE FIGURES

These and other aspects of the invention are depicted in detail in the figures as follows.

DETAILED DESCRIPTION OF THE EXEMPLARY EMBODIMENTS

Figure 1:
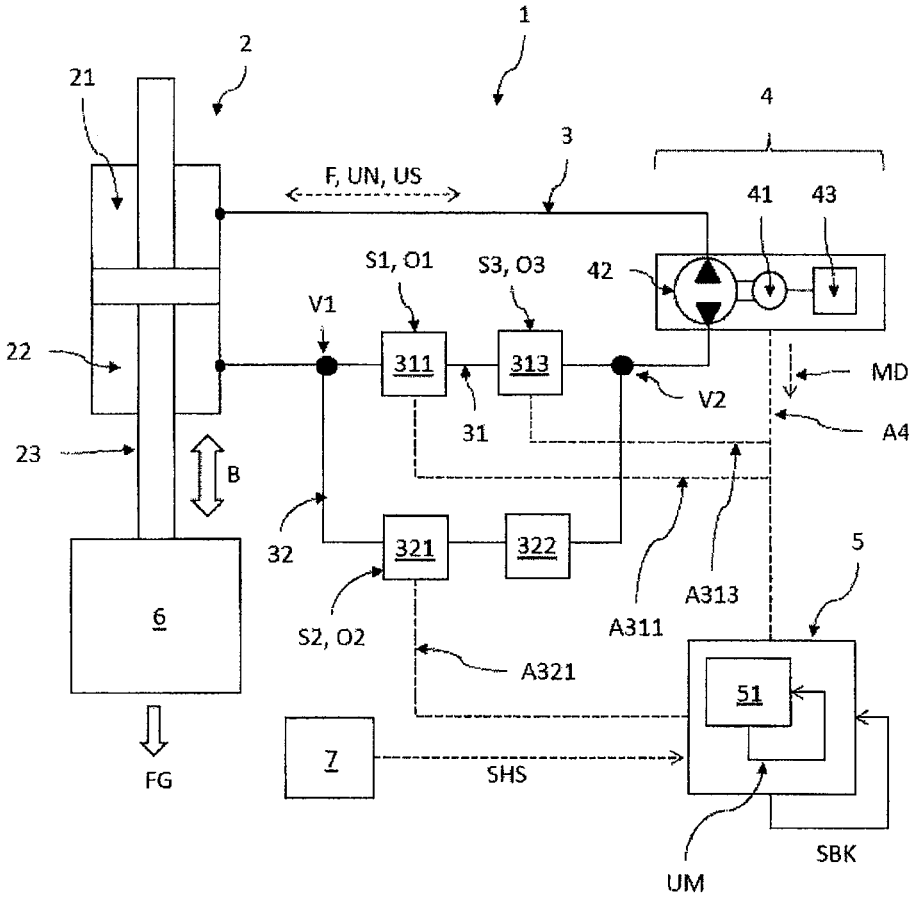
FIG. 1 is a schematic representation of an embodiment of the drive system according to the invention.

FIG. 1 is a schematic representation of an embodiment of the drive system 1 according to the invention, in which a piston rod 23 of a synchronized cylinder 2, with a first cylinder chamber 21 and a second, separate cylinder chamber 22, is moved. To this end, the cylinder chambers 21, 22 are connected to one another, via a connecting line 3, and, together with the connecting line 3, form a hydraulic circuit (a closed pressure circuit in this case), which is filled with a fluid F as the hydraulic fluid. The fluid F is conveyed UN, US from one cylinder chamber 21, 22 into the other cylinder chamber 21, 22 via the connecting line 3 in order to move the piston rod 23 with a hydraulic drive 4, which is arranged at a suitable position in the connecting line 3, which can be selected by an expert. In this embodiment, the connecting line 3 incorporates a parallel system consisting of a first sub-connection 31 and a second sub-connection 32 between the hydraulic drive 4 and the second cylinder chamber 22. The two sub-connections branch out from the hydraulic drive, when viewed at connecting point V2, and come back together again at connecting point V1. The two sub-connections 31, 32 depicted here have differing lengths between the connecting points V1 and V2, wherein the second sub-connection 32 is longer. The two sub-connections 31, 32 can, however, also have the same length between connecting points V1 and V2. In another embodiment, the two sub-connections 31, 32 can also be arranged between the hydraulic motor 4 and the first cylinder chamber 21, wherein here, the position of the sub-connections 31, 32 is independent of the type of cylinder 2. In other embodiments, more than two sub-connections can also be arranged in the connecting line 3, wherein, however, at least one of the sub-connections has a baffle 322 according to the present invention. Here, the first sub-connection 31 incorporates a first stop valve 311 and a third stop valve 313, arranged in series with it (behind one another in the direction of flow), so that the fluid F first flows through one and then through the other stop valve, depending on the direction of flow. In other embodiments not depicted here, there is no third stop valve 313. Preferably, the third stop valve 313 has the same switch settings as the first stop valve 311 in normal mode N and in safe mode S and thus represents a redundant component. The connecting line 3, including the first sub-connection 31, that is, the connection from the first cylinder chamber 21 to the second connection point V2, the first sub-connection 31 (not the second sub-connection 32) and the connecting line between first connection point V1 and the second cylinder chamber 22, represents a first flow resistance for the fluid F and, to that end, has a smallest first cross-sectional area Q3*a*, through which the fluid F flows, and the size of the cross-sectional area is measured so that the drive system 1 has no or only a slight loss of power in normal mode N and thus the force acting upon the piston rod 23 is determined by the power of the hydraulic drive 4. The first smallest cross-sectional area Q3*a* is thus smaller than or the same size as all of the other cross-sectional areas in the previously described connecting line. Here, the second sub-connection 32 incorporates a second stop valve 321 and a baffle 322 arranged in series with this, in order to provide a second flow resistance by means of the baffle 322, which, to this end, has a second cross-sectional area Q3*b*, reduced in comparison with the first cross-sectional area Q3*a*, through which the fluid F flows in at least safe mode S. The second cross-sectional area Q3*b* thus represents an additional flow resistance with respect to the rest of the connecting line with the smallest cross-sectional area Q3*a* for the fluid F and thus determines the second flow resistance through the second sub-connection 32. This additional flow resistance is not effective in normal mode N, however, since the drive system 1 is operated with an open first stop valve 311 and preferably, as shown here, with a closed second stop valve 321, in order to convey UN the fluid F in the normal mode N. In other embodiments not depicted here, there is no second stop valve 321, which means that the fluid F can also flow through the second sub-connection 32 with the second flow resistance in normal mode N. In another embodiment, the second stop valve 321 could also remain open in normal mode N as the flow resistance is determined by the remaining connecting line, including the first sub-connection 31, and thus the first flow resistance, the smallest first cross-sectional area Q3*a* of which is greater than the second cross-sectional area Q3*b*. In this case, the second sub-connection 32 would merely be a bypass.

In another embodiment not depicted here, the second stop valve 321 could also be arranged outside the second sub-connection 32, between the second cylinder chamber 22 and the first connection point V1 or between the first cylinder chamber 21 and the second connection point V2. The first and the second stop valves 311, 321 would then be open for the normal mode N. For the safe mode S, only the first stop valve 311 would be closed, while the second stop valve 321 would remain open. To shut the drive system down, only the second stop valve 321 would then need to be closed in this embodiment, which is not depicted here.

Here, the cross-sectional areas Q3*a*, Q3*b* denote the inner area of the respective connecting line 3, which is perpendicular to the direction of flow of the fluid F. At the same time, the cross-sectional areas Q3*a*, Q3*b* denote the smallest cross-sectional areas present in the respective connections 3, 31, 32 (connecting line) since the respectively smallest cross-sectional area determines the flow resistance in the respective connecting line. In safe mode S, then, the drive system 1 is operated with a closed first stop valve 311 and with an open second stop valve 321. Thus, the fluid F is forced to pass the baffle 322 when conveyed US. Because the second cross-sectional area Q3*b* is suitable (small) and thus a suitably high second flow resistance has been selected, a maximum permissible speed of the piston rod 23 in safe mode S is thus defined, even with an external force FG acting on the drive system 1 in the direction of movement B of the piston rod 23, which cannot be exceeded due to the flow resistance due to the baffle 322. When there is a shutdown ST of the drive system 1, on the other hand, at least the first and second stop valve 311, 321 are closed; preferably, all stop valves 311, 321, 313 are closed in this case. Here, in order to be able to operate the drive system easily, the stop valves 311, 321, 313 are designed to be able to be switched electronically and are connected to a drive control 5 in order to switch the stop valves 311, 321, 313 electronically. The same also applies to the hydraulic drive 4 in order to move the piston rod 23. The corresponding actuation signals are represented schematically as A311, A313, A321, and A4, using dashed lines. Here, the hydraulic drive 4 is an electro-hydrostatic drive, which comprises an electric motor 41 and a hydraulic pump 42 driven by the motor with a typical slippage of fluid F, regardless of the direction of the pump and the throughput rate of the pump. This slippage becomes irrelevant from a safety perspective, due to the arrangement according to the invention with the second sub-connection 32. The motor 41 is also connected to a tachometer 43 for measuring the motor speed MD; the measurement is transmitted to the drive control 5 (dashed arrow) and, based on this, the movement of the piston rod 23 is controlled by the drive control 5. In addition, the drive control 5 incorporates a safety logic circuit 51, which switches UM the stop valves 311, 321, 313 from normal mode N to safe mode S, for example, in response to safety signals SHS received by a safety unit 7. The safety unit 7 can represent, for example, an access monitoring mechanism 7 for the movement area of the machine operated with the drive system 1 according to the invention. If a person enters the movement area, the access monitoring mechanism transmits the safety signals SHS to the drive control 5, and, in response, its safety logic circuit 51 switches UM the drive system 1 to safe mode S. The safety logic circuit 51 can also be designed for the purposes of switching UM from normal mode N to safe mode S when the hydraulic drive 4 is overloaded in order at least to throttle, or preferably to stop, the hydraulic drive 4.

Figure 2:
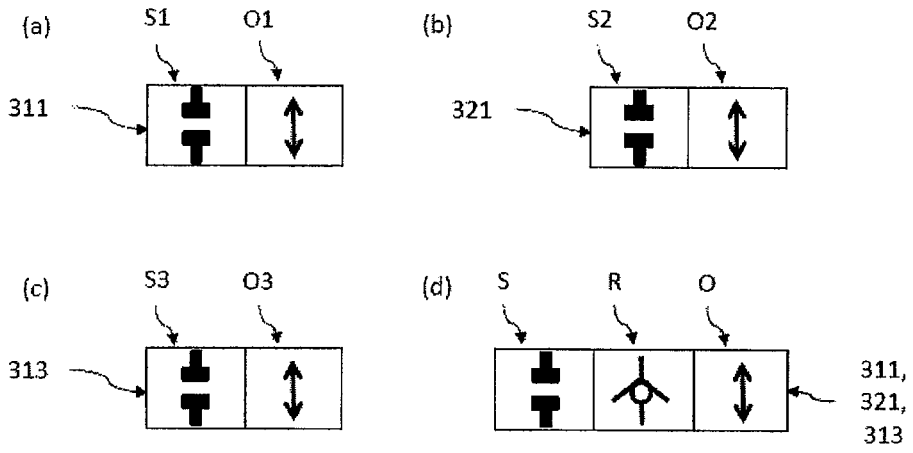
FIG. 2 depicts examples of switch settings available in the stop valves for (a) the first stop valve, (b) the second stop valve, (c) the third stop valve, and (d) for alternative switch settings for the stop valves.

FIG. 2 depicts examples of switch settings available in the stop valves for (a) the first stop valve 311, (b) the second stop valve 321, (c) the third stop valve 313, and (d) for alternative switch settings for the stop valves 311, 321, 313. Figures (a)-(c) each depict switch settings of 2/2-way valves, wherein S1, S2, S3 indicate the stop divisions of the first, second, and third stop valves 311, 321, 313. Accordingly, O1, O2, O3 indicate the settings of the stop valves 311, 321, and 313, in which the fluid can flow through the stop valves in both directions unimpeded. In an alternate embodiment, one or more stop valves 311, 321, 313 can also have more than just two switch settings, for example, a return setting R, in addition to a stop setting S and an open setting O. This can also be set in normal mode, for example, for the second switching valve 321.

Figure 3:
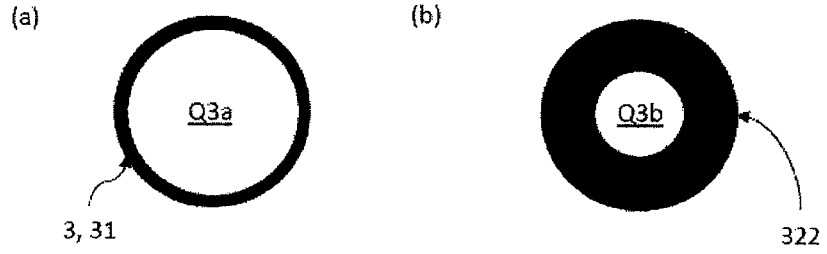
FIG. 3 is a schematic representation of the first (a) and second (b) cross-sectional areas in the connecting line, through which fluid flows as it is conveyed.

FIG. 3 is a schematic representation of the first (a) and second (b) cross-sectional areas Q3*a*, Q3*b* in the connecting line 3, through which fluid flows as it is conveyed. The first and second cross-sectional areas Q3*a* and Q3*b* denote the inner area of the respective connecting line 3, 31, 32, through which fluid F can pass as it is conveyed and which is perpendicular to the direction of flow of the fluid F as it passes through. The second cross-sectional area Q3*b* is depicted as significantly smaller than the first cross-sectional area Q3*a*, so that the second cross-sectional area Q3*b* represents the significantly largest second flow resistance in the entire connecting line. In hydraulic drives 4, whose rotational speed is not monitored and controlled, the second cross-sectional area Q3*b* is designed to be smaller than it is in hydraulic drives 4 with rotational speed monitoring and rotational speed control for limiting the speed during safe mode S since, in the latter case, the baffle 322 with the second flow resistance provided in this manner must only compensate for the volume slippage through the hydraulic drive 4, while the baffle 322 in the first case must safely limit the volumetric flow independently of the hydraulic drive 4 with the correspondingly greater second flow resistance. The first cross-sectional area Q3*a*, on the other hand, does not determine the flow resistance of the connecting line 3 if the fluid F is only able to flow through the second sub-connection 32, as is the case in safe mode S. However, if the fluid can flow through the first sub-connection 31 in normal mode N, then the first flow resistance in the entire connecting line 3 is only determined by the first cross-sectional area Q3*a* since, on one hand, the first cross-sectional area Q3*a* represents the smallest cross-sectional area in the connecting line 3 through which fluid flows (in this case, there is no fluid F flowing through the second sub-connection 32 at all) when the second sub-connection is blocked, and, on the other hand, when the second sub-connection 32 is open, this only represents a bypass, which cannot negatively influence the flow resistance of the connecting line 3 since the second sub-connection 32 is a parallel connection with the rest of the connecting line 3.

Figure 4:
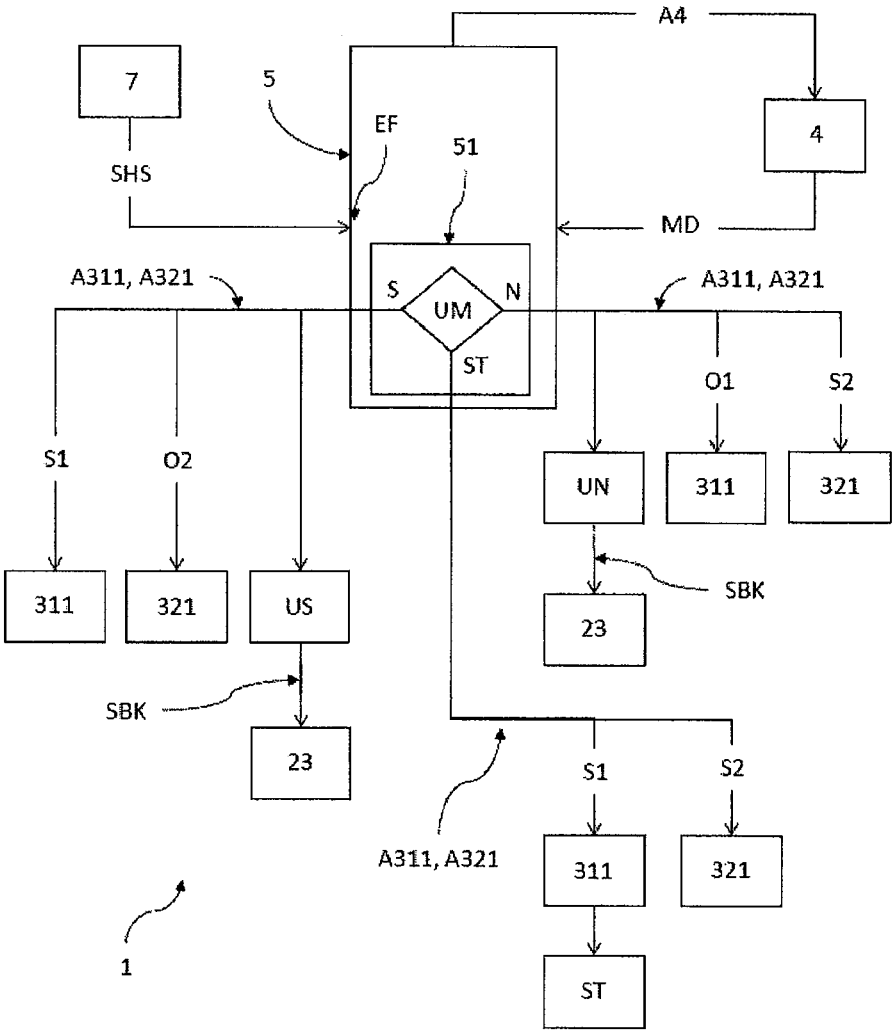
FIG. 4 is a schematic representation of an embodiment of the method according to the invention for operating the drive system according to the invention.

FIG. 4 is a schematic representation of an embodiment of the process according to the invention for operating the drive system 1 according to the invention as depicted in FIG. 1. Here, the drive system 1 starts with opening O1 the first stop valve 311 and, additionally, with closing S2 the second stop valve 321 for a normal mode N of the drive system 1 (in an alternate embodiment, the latter can also be omitted, whereby the second stop valve 321 can remain in an open state). To this end, the stop valves 311 and 321, which can be actuated electronically, are accordingly actuated A311, A321 by the drive control 5. Subsequently, the piston rod 23 of the cylinder 2 is moved in a controlled manner SBK, as desired in the respective application, from one cylinder chamber 21, 22, via the first sub-connection 31, into the other cylinder chamber 21, 22, by conveying UN the fluid F by means of the hydraulic drive 4. To this end, the hydraulic drive 4 is actuated A4 accordingly by the drive control 5 in order to move the piston rod 23. During operation, the drive control 5 receives EF safety signals SHS, which are evaluated in the additional safety logic circuit 51. If necessary, the safety logic circuit 51 initiates switchover UM from normal mode N to safe mode S, based on the safety signals SHS received. In addition, in this embodiment, the motor speed MD of the motor 41 measured by means of a tachometer 43 is transmitted to the drive control 1. In addition to the control SBK of the movement of the piston rod 23 by means of the motor speed MD transmitted by the drive control 1, the safety logic circuit 51 can initiate a switchover UM from normal mode N to safe mode when the hydraulic drive 4 is overloaded, which will result in at least throttling the hydraulic drive 4 or preferably stopping the hydraulic drive 4. To this end, the drive control 5 controls A311, A321 the closing S1 of the first stop valve 311 and the opening O2 of the second stop valve 321, whereby a maximum permissible speed of the piston rod 23 is not exceeded in the safe mode S, even where an external force FG (for example gravity or gravitational force) acts upon the drive system 1 in the direction of movement B of the piston rod 23, by the second cross-sectional area Q3*b* having been selected as suitable to provide an additional second flow resistance for the fluid F through the baffle 322. Subsequently, in safe mode S, the fluid F is conveyed US by means of the hydraulic drive 4 from one cylinder chamber 21, 22, via the second sub-connection 32, into the other cylinder chamber 21, 22 in order to move the piston rod 23 of the cylinder 2. Alternately or subsequently to this, the process can include the additional step of closing SI, S2 at least the first and second stop valves 311, 321 to stop ST the drive system 1. If it is determined that the maximum safe rotational speed has been exceeded in safe mode S, then the motor can be stopped (power switched off), and the second stop valve 321 can be closed. These measures would then lead to a shutdown of the drive system 1.

The embodiments depicted here only represent examples of the present invention and are therefore not to be understood as limiting. Alternate embodiments considered by the expert are similarly encompassed by the protective scope of the present invention.

LIST OF REFERENCE CHARACTERS

1 Drive system according to the invention
2 Cylinder
21 First cylinder chamber
22 Second cylinder chamber
23 Piston rod
3 Connecting line
31 First sub-connection
311 First stop valve
313 Third stop valve
32 Second sub-connection
321 Second stop valve
322 Baffle (flow resistance)
4 Hydraulic drive
41 Electric motor
42 Pump
43 Tachometer
5 Drive control (including converter and driver)
51 Safety logic circuit
6 Driven object
7 Safety unit
A311 Actuation of first stop valve
A313 Actuation of third stop valve
A321 Actuation of second stop valve
A4 Actuation of hydraulic drive
B Movement of the piston rod
EF Reception of safety signals
F Fluid
FG External force, for example force of gravity
MD Rotational speed of hydraulic drive (motor speed)
N Normal mode
O1 Opening of the first stop valve (open position)
O2 Opening of the second stop valve (open position)
O3 Opening of the third stop valve (open position)
Q3*a* First cross-section of the connecting line
Q3*b* Second cross-section of the connecting line
SI Closing of the first stop valve
S2 Closing of the second stop valve
S3 Closing of the third stop valve
S Safe mode
SBK Control of the movement of the piston rod
SHS Safety signal
ST Shutdown of the drive system
UM Switchover from normal mode to safe mode
UN Conveyance of fluid in normal mode
US Conveyance of fluid in safe mode
V1 First connection point
V2 Second connection point

The invention claimed is:

1. A hydraulic drive system for moving a piston rod of at least one cylinder, the drive system comprising at least a first cylinder chamber and a second cylinder chamber separated from the same, which are connected to one another via a connecting line to form a fluid-filled hydraulic circuit, and a hydraulic drive for conveying the fluid from one cylinder chamber, via the connecting line, into the other cylinder chamber, is arranged in connecting line, wherein the connecting line has at least one parallel system of at least one first sub-connection with at least one first stop valve and a second sub-connection with a baffle arranged therein, between the hydraulic drive and one of the two cylinder chambers, wherein the connecting line, excluding the second sub-connection, has a first flow resistance and the second sub-connection has a second flow resistance due to the baffle arranged therein, which is greater than the first flow resistance for the fluid, wherein the drive system is provided with at least one open first stop valve in normal mode and with a closed first stop valve in safe mode for conveying the fluid, and a suitably high second flow resistance has been selected such that a maximum permissible speed for the piston rod is not exceeded in safe mode, even where an external force acts on the drive system in the direction of movement of the piston rod, wherein the first stop valve can be operated electronically and the drive system includes a drive control for actuating the hydraulic drive for moving the piston rod and for electronic switching of at least the first stop valve for at least normal and safe mode, wherein the hydraulic drive incorporates a tachometer for monitoring the rotational speed of the hydraulic motor, and wherein the tachometer is connected to the drive control for at least safe limiting of the rotational speed by drive control.

2. The drive system according to claim 1, wherein the hydraulic drive is an electro-hydrostatic drive with an electric motor and a hydraulic pump driven by the electric motor via a motor shaft, wherein the tachometer is provided for measuring the rotational speed of the electric motor.

3. The drive system according to claim 1, wherein the first sub-connection incorporates a third stop valve arranged in series with the first stop valve and which preferably has the same switch settings as the first stop valve in normal mode and in safe mode.

4. The drive system according to claim 1, wherein the second stop valve can also be switched electronically;

preferably, the third stop valve and, if required, all other stop valves can also be switched electronically.

5. A method of operating a drive system including at least one cylinder with at least one cylinder chamber and one second cylinder chamber separated from the same, which are connected to one another via a connecting line to form a fluid-filled hydraulic circuit with a hydraulic drive arranged therein, and the connecting line has at least one parallel system, between the hydraulic drive and one of the two cylinder chambers, of at least one first sub-connection with at least one first stop valve and a second sub-connection with a baffle arranged therein, wherein the connecting line, including the first sub-connection and excluding the second sub-connection, has a first flow resistance and the second sub-connection, has a second flow resistance determined by the baffle arranged therein, which is greater than the first flow resistance for the fluid, the method comprising the following steps:

opening at least the first stop valve for a normal mode of the drive system;

conveying the fluid by means of the hydraulic drive in normal mode from one cylinder chamber, via at least the first sub-connection, into the other cylinder chamber in order to move a piston rod of the cylinder;

closing the first stop valve in order to operate the drive system in a safe mode, wherein a maximum permissible speed of the piston rod is not exceeded in the safe mode, even where an external force acts on the drive system in the direction of movement of the piston rod, by having selected a suitably high second flow resistance; and conveying the fluid by means of the hydraulic drive in safe mode from one cylinder chamber, via the second sub-connection, into the other cylinder chamber in order to move the piston rod of the cylinder.

6. The method according to claim 5, including the additional step of actuating the hydraulic drive in order to move the piston rod and at least the first stop valve by means of a drive control of the drive system for at least normal and safe mode, for which at least the first stop valve is designed to be able to be switched electronically.

7. The method according to claim 6, including the following additional steps:

receiving safety signals by means of the drive control, which additionally incorporates a safety logic circuit and switching from normal mode to safe mode based on the safety signals received from the safety logic circuit.

8. The method according to claim 6, wherein the hydraulic drive incorporates a tachometer for monitoring the rotational speed of the hydraulic motor, wherein the tachometer is connected to the drive control for at least safe limiting of the rotational speed by the drive control, including the following additional steps:

transmitting a rotational speed of the hydraulic drive measured by the tachometer to the drive control;

controlling the movement of the piston rod by the drive control, by means of the transmitted rotational speed and switching from normal mode to safe mode by means of the drive control where the hydraulic drive is overloaded, in order at least to throttle the hydraulic drive; preferably, the hydraulic drive is stopped.

9. The process according to claim 5 including the additional step of closing a second stop valve, which is arranged outside of the first sub-connection, in order to enable a shutdown of the drive system.

10. A hydraulic drive system for moving a piston rod of at least one cylinder, the drive system comprising at least a first cylinder chamber and a second cylinder chamber separated from the same, which are connected to one another via a connecting line to form a fluid-filled hydraulic circuit, and a hydraulic drive for conveying the fluid from one cylinder chamber, via the connecting line, into the other cylinder chamber, is arranged in connecting line, wherein the connecting line has at least one parallel system of at least one first sub-connection with at least one first stop valve- and a second sub-connection with a baffle arranged therein, between the hydraulic drive-and one of the two cylinder chambers, wherein the connecting line, excluding the second sub-connection, has a first flow resistance and the second sub-connection has a second flow resistance due to the baffle arranged therein, which is greater than the first flow resistance for the fluid, wherein the drive system is provided with at least one open first stop valve in normal mode and with a closed first stop valve in safe mode for conveying the fluid, and a suitably high second flow resistance has been selected such that a maximum permissible speed for the piston rod is not exceeded in safe mode, even where an external force acts on the drive system in the direction of movement of the piston rod, wherein the first stop valve can be operated electronically and the drive system includes a drive control for actuating the hydraulic drive for moving the piston rod and for electronic switching of at least the first stop valve for at least normal and safe mode, and wherein the drive control incorporates a safety logic circuit, which is provided in order at least to switch over at least the first stop valve from normal mode to safe mode, in response to the safety signals received.

11. The drive system according to claim 10, wherein the safety logic circuit is provided for the purposes of switching from normal mode to safe mode when the hydraulic drive is overloaded in order at least to throttle or preferably to stop the hydraulic drive.

12. A hydraulic drive system for moving a piston rod of at least one cylinder, the drive system comprising at least a first cylinder chamber and a second cylinder chamber separated from the same, which are connected to one another via a connecting line to form a fluid-filled hydraulic circuit, and a hydraulic drive for conveying the fluid from one cylinder chamber, via the connecting line, into the other cylinder chamber, is arranged in connecting line, wherein the connecting line has at least one parallel system of at least one first sub-connection with at least one first stop valve- and a second sub-connection with a baffle arranged therein, between the hydraulic drive-and one of the two cylinder chambers, wherein the connecting line, excluding the second sub-connection, has a first flow resistance and the second sub-connection has a second flow resistance due to the baffle arranged therein, which is greater than the first flow resistance for the fluid, wherein the drive system is provided with at least one open first stop valve in normal mode and with a closed first stop valve in safe mode for conveying the fluid, and a suitably high second flow resistance has been selected such that a maximum permissible speed for the piston rod is not exceeded in safe mode, even where an external force acts on the drive system in the direction of movement of the piston rod, wherein the first stop valve can be operated electronically and the drive system includes a drive control for actuating the hydraulic drive for moving the piston rod and for electronic switching of at least the first stop valve for at least normal and safe mode, and wherein a second stop valve is arranged in the connecting line outside of the first sub-connection in order to enable safe shutdown of the drive system.

13. The drive system according to claim 12, wherein the second stop valve is arranged in the second sub-connection in series with the baffle; preferably, the second stop valve is closed in normal mode.

* * * * *